US008668602B1

(12) United States Patent
Kieffaber

(10) Patent No.: US 8,668,602 B1
(45) Date of Patent: Mar. 11, 2014

(54) ATHLETIC SWINGING TRAINING SYSTEM, METHOD, AND APPARATUS

(76) Inventor: Paul M. Kieffaber, Kansas City, MO (US)

( * ) Notice: Subject to any disclaimer, the term of this patent is extended or adjusted under 35 U.S.C. 154(b) by 1 day.

(21) Appl. No.: 12/896,376

(22) Filed: Oct. 1, 2010

Related U.S. Application Data

(60) Provisional application No. 61/247,874, filed on Oct. 1, 2009.

(51) Int. Cl.
*A63B 69/00* (2006.01)
*A63B 65/02* (2006.01)

(52) U.S. Cl.
USPC ..... 473/451; 473/422; 473/585; 473/575; 473/417

(58) Field of Classification Search
USPC ..... 473/422, 423, 427, 429, 430, 417, 451, 473/575, 576, 585, 425
See application file for complete search history.

(56) References Cited

U.S. PATENT DOCUMENTS

| | | | | | |
|---|---|---|---|---|---|
| 302,094 | A | * | 7/1884 | Briggs | 124/7 |
| 2,193,645 | A | * | 3/1940 | Raizen et al. | 473/580 |
| 2,354,790 | A | * | 8/1944 | Beck | 473/579 |
| 2,611,999 | A | * | 9/1952 | Mikolay | 446/400 |
| 3,264,777 | A | * | 8/1966 | McCreary, Jr. | 473/586 |
| 3,393,911 | A | * | 7/1968 | Lawson | 473/576 |
| 3,437,340 | A | * | 4/1969 | Grise | 473/200 |
| 3,507,494 | A | * | 4/1970 | Finkel | 473/526 |
| 3,528,659 | A | * | 9/1970 | Benham | 473/514 |
| 3,691,674 | A | * | 9/1972 | Thompson | 446/34 |
| 3,784,199 | A | * | 1/1974 | Chmela | 273/398 |
| 3,897,057 | A | * | 7/1975 | Pennington | 473/427 |
| 4,021,041 | A | * | 5/1977 | Goldfarb et al. | 473/585 |
| 4,101,128 | A | * | 7/1978 | Yellen | 473/459 |
| 4,257,613 | A | * | 3/1981 | Meyer Thor Straten | 473/574 |
| 4,826,179 | A | * | 5/1989 | Callaghan | 473/575 |
| 4,930,777 | A | * | 6/1990 | Holenstein | 473/598 |
| 4,997,190 | A | * | 3/1991 | Chmela | 473/585 |
| 5,016,891 | A | * | 5/1991 | Nelson | 273/407 |
| 5,066,017 | A | * | 11/1991 | Kurland | 473/572 |
| 5,067,728 | A | * | 11/1991 | Dadbeh | 473/585 |
| 5,211,612 | A | * | 5/1993 | Carbonero | 473/576 |
| 5,230,650 | A | * | 7/1993 | Brayton | 473/402 |
| 5,267,735 | A | * | 12/1993 | Bushman | 473/586 |
| 5,290,041 | A | * | 3/1994 | Kettelson | 273/400 |
| 5,362,066 | A | * | 11/1994 | Sassak | 473/572 |
| D361,811 | S | * | 8/1995 | Grimm et al. | D21/712 |
| 5,494,278 | A | * | 2/1996 | Linden | 473/427 |
| 5,779,576 | A | * | 7/1998 | Smith et al. | 473/570 |
| 5,860,879 | A | * | 1/1999 | Gable | 473/575 |
| 6,010,419 | A | * | 1/2000 | Rappaport et al. | 473/613 |
| 6,068,260 | A | * | 5/2000 | Dean | 273/400 |
| 6,083,127 | A | | 7/2000 | O'Shea | |
| 6,227,991 | B1 | * | 5/2001 | Carlton et al. | 473/580 |

(Continued)

FOREIGN PATENT DOCUMENTS

| | | | | | |
|---|---|---|---|---|---|
| CN | 1778441 | A | * | 5/2006 | A63B 67/18 |

*Primary Examiner* — Mitra Aryanpour
(74) *Attorney, Agent, or Firm* — Anderson & Levine, L.L.P.

(57) ABSTRACT

A method for training a user to swing a member at a moving target. The method comprises receiving in an area proximate the member a target object projected along a free space path toward the area. The method also comprises striking, by the user, the target object with the member. In the method, the target object comprises a target member having a majority of its length along the free space path.

19 Claims, 5 Drawing Sheets

(56) References Cited

U.S. PATENT DOCUMENTS

| | | | | |
|---|---|---|---|---|
| 6,514,161 | B1 * | 2/2003 | Minniear | 473/428 |
| 6,612,942 | B1 * | 9/2003 | Battersby et al. | 473/451 |
| 6,669,587 | B2 * | 12/2003 | Kessler | 473/613 |
| 6,682,448 | B2 * | 1/2004 | Jamison | 473/579 |
| 6,733,405 | B2 * | 5/2004 | Gormley | 473/575 |
| 6,752,138 | B2 * | 6/2004 | Taryoto | 124/78 |
| 6,926,579 | B2 * | 8/2005 | Rappaport | 124/64 |
| 6,976,926 | B2 * | 12/2005 | LaPointe | 473/429 |
| 7,288,037 | B2 * | 10/2007 | Myers | 473/613 |
| D562,411 | S * | 2/2008 | Jones et al. | D21/387 |
| 8,220,392 | B1 * | 7/2012 | Maldonado et al. | 102/368 |
| 2002/0032087 | A1 * | 3/2002 | Jamison | 473/579 |
| 2002/0164921 | A1 * | 11/2002 | Wilkinson et al. | 446/308 |
| 2006/0135291 | A1 * | 6/2006 | Biegen | 473/451 |
| 2006/0223658 | A1 * | 10/2006 | Blanco | 473/451 |
| 2006/0276277 | A1 * | 12/2006 | Montefusco | 473/586 |
| 2008/0020873 | A1 * | 1/2008 | Miller et al. | 473/575 |
| 2009/0011870 | A1 * | 1/2009 | Neal et al. | 473/451 |
| 2010/0255939 | A1 * | 10/2010 | York | 473/451 |

* cited by examiner

ATHLETIC SWINGING TRAINING SYSTEM, METHOD, AND APPARATUS

CROSS-REFERENCES TO RELATED APPLICATIONS

This application claims priority, and the benefit of the filing date, under 35 U.S.C. §119 of U.S. Provisional Application No. 61/247,874, filed Oct. 1, 2009, and which is hereby incorporated herein by reference.

STATEMENT REGARDING FEDERALLY SPONSORED RESEARCH OR DEVELOPMENT

Not Applicable.

BACKGROUND OF THE INVENTION

The present embodiments relate to athletics and are more particularly directed to a system, method, and apparatus for training a user to swing a member at a moving target, preferably in the context of swinging a ball bat (e.g., baseball or softball).

The field of training baseball and softball players typically strives to develop their ability to swing a bat effectively and to get quality hits more consistently through meaningful practice repetitions. For many players, this is achieved through traditional "batting practice," wherein over numerous repetitions the batter attempts to strike with his bat an appropriate ball (i.e., either baseball or softball) that is either manually or mechanically projected toward an area adjacent the batter. The practice may be with or without the assistance from one or more persons observing the batter and then attempting to provide guidance to the batter on how to improve his swing. The batter of course is also able to make his own adjustments based on his own observations. Batting practice of this sort, however, involves practical challenges that may in some instances provide drawbacks in accomplishing the practice. Such drawbacks include providing space requirements for facilitating the flight of hit balls, which generally require use of an actual fenced baseball/softball field, an enclosed batting cage, or a fairly large, unpopulated area. Other drawbacks of this technique include: (i) the time and energy required in retrieving balls which, once hit, tend to travel long distances and in myriad directions; and (ii) the ability of non-professional pitchers to effectively deliver proper pitches, that is, to throw balls into the hitting zone consistently for the purpose of efficient and meaningful batting practice. Note that this latter concern is sometimes addressed through the use of an electromechanical pitching device, which while improving accuracy also greatly increases the cost of the system and is also subject to maintenance and repair requirements.

In addition to batting practice, the field of training baseball and softball players also has included numerous swing training systems and devices, some more recent and some that have been around for many years, as further detailed below.

A first known example of a batting practice system and method includes a tethered ball that is affixed to a rope which is connected to a fixed point. This system provides a repeating swing target for batters as they strike the ball and then wait as the tether uncoils and sends the ball back into the hitting zone. This system, however, has various drawbacks, including: (i) it does not require the hitter to track a pitch-like arc of the target/ball; and (ii) it does not give the hitter multi-dimensional swing feedback once the target/ball is struck.

A second known example of a batting practice system and method includes a ball on a zip line, where the ball has a hole in diametrically opposed positions on its surface and through which a pair of static-line ropes pass. An operator of the device pulls the two rope lengths apart, thereby causing the ball to advance along the rope and if properly positioned to advance to a hitting zone adjacent a batter. This system provides a repeatable target for a batter, does not require batted balls to be collected once hit, and gives a batter a roughly pitch-like target/ball to track. This system, however, has various drawbacks, including: (i) the flight of the target/ball is not affected by gravity but is instead shuttled along the rope lengths in an unnatural manner; (ii) it does not give the batter multi-dimensional swing feedback once the ball is struck; and (iii) it does not give the batter the ability to swing freely through the entire hitting zone, as the necessary rope lengths run through the middle of the hitting zone and thus can force the bat into contact with the flight of the ball along the static line or alternatively may cause the batter to contact the rope in lieu of the ball.

A third known example of a batting practice system and method is a so-called "hitting stick." This apparatus includes as the batting target a molded target/ball affixed to one end of a long flexible (e.g., rubberized) member, and a batter practicing with the device is assisted by a person that holds a distant end of the member and physically leads the target/ball on the member's opposite end into the hitting zone for the batter to hit. This product sometimes is affixed to a mechanized stand that replaces the assisting operator. This system provides a repeatable target for a batter and does not require the batted "ball" to be collected as the ball remains permanently affixed to the stick member. This system, however, has various drawbacks, including: (i) it does not require the batter to track a pitch-like arc of the target/ball; (ii) it does not give the hitter multi-dimensional swing feedback once the target/ball is struck; and (iii) in the case of the hand held version the blow to the stick causes a shock to the person holding the distant end and there is also potential danger involved should that person release the end of the stick while the ball is struck.

A fourth known example of a batting practice system and method includes a combination of practice balls and a simplified or "micro" bat. In this system, the practice balls are typically light-weight (e.g., generally plastic) balls of various materials and sizes, introduced into the hitting zone by either a toss from a "pitcher" or via an automated device (i.e., a pitching machine). The system often employs a thin bat or stick to force the batter to focus more intently on making contact with the projected ball. This system gives the batter repeatable practice at tracking the target/ball into the hitting zone on a (somewhat) pitch-like arc and also provides limited multi-dimensional feedback as to the effectiveness of each individual swing result. One drawback, however, is the weight of the ball; as the weight of the practice ball approaches that of an actual regulation baseball or softball, the space requirements will approach that of an actual live batting practice and thus provide no simulation benefit. Therefore, target/balls must be kept light (generally hollow plastic). As such; their flight is restricted such that they can be hit in a reasonably small space without concern over damage to property or injury to "pitcher", but the trajectory commensurate with this reduced weight does not produce an overly realistic pitch-like arc. In addition, in such a system the simplified bat does not necessarily approximate the realistic length, weight, or feel of a regulation bat.

In all events, swing training systems, methods, and apparatus are useful to the extent that they can accurately simulate live batting practice conditions for a batter's practice. Further, while the preceding approaches have useful application, the present inventor has observed that they may be improved upon by addressing some or all of the above-stated drawbacks. Such improvements are borne out in the preferred embodiments, as discussed below.

BRIEF SUMMARY OF THE INVENTION

In a preferred embodiment, there is a method for training a user to swing a member at a moving target. The method comprises receiving in an area proximate the member a target object projected along a free space path toward the area. The method also comprises striking, by the user, the target object with the member. In the method, the target object comprises a target member having a majority of its length along the free space path.

Other aspects are also disclosed and claimed.

DETAILED DESCRIPTION OF THE INVENTION

By way of introduction to the preferred embodiments, the following terms are defined.

(1) Hitting Zone—The area directly in front of the batter where the target/ball is to be hit; aka the strike zone in baseball/softball games.

(2) Live Batting Practice—Refers to the act of pitching and hitting actual baseballs or softballs in a requisite space.

(3) Multi-Dimensional Swing Feedback—Refers to the various ways in which the target/ball, once struck, provides the batter and/or instructor with meaningful information as to how successful a given swing was. Examples include:

a. The distance a target when struck by the bat travels from the bat;

b. The direction traveled by the target when struck by the bat;

c. The solidness of contact between the bat and the target (i.e., was target struck in the center of the bat as opposed to a more glancing contact);

d. The percussive sound generated through contact.

(4) Target Object—Refers to the specific object at which the batter will be swinging; it simulates an actual baseball/softball but preferably has attributes that differ from a baseball/softball, as detailed below.

(5) Pitch-Like Arc—Refers to the relative quality of simulation achieved through the manner in which the Target Object is introduced to the Hitting Zone as compared with that of an actual pitched baseball/softball.

(6) Launching Mechanism—Refers to an apparatus for accurately projecting the Target Object with a Pitch-Like Arc along a path toward the Hitting Zone.

(7) Pitcher—Refers to a batters' partner (if required) who by one means or another, such as through operation of the Launching Mechanism, sends the Target Object into the Hitting Zone.

Figure 1:
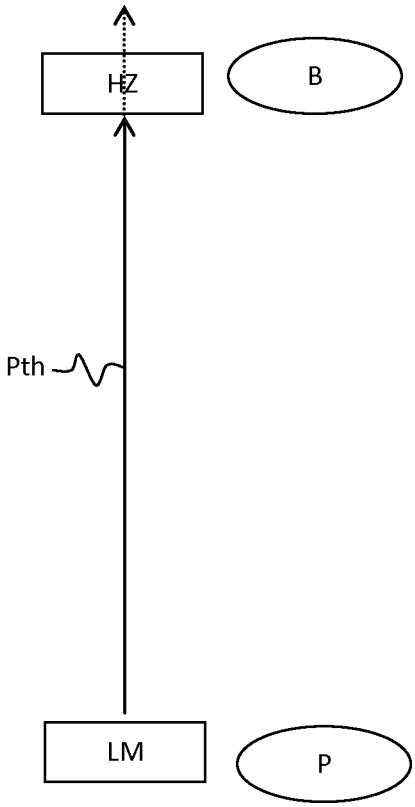
FIG. 1 illustrates diagrammatically in a top down view a launching member, possibly operated by a pitcher, and launching a target object (not shown) along a path toward a hitting zone proximate a batter.

The present inventor has discovered a manner of achieving numerous advantages in the challenge of training baseball and softball players to develop their ability to swing a bat effectively and to get quality hits more consistently through meaningful practice repetitions by developing the use of a Target Object that is other than the traditional spherical baseball or softball. Specifically, in the preferred embodiments, and as shown diagrammatically in a top down view in FIG. 1, a Pitcher (P) operates a Launching Mechanism (LM) to project a Target Object ((TO); not shown in FIG. 1) with a Pitch-Like Arc along a path (Pth) toward the Hitting Zone (HZ), where it is understood that a batter (B) is standing proximate the Hitting Zone (HZ) in an effort to swing a bat and make contact with the Target Object (TO). Preferably and as detailed later, the Target Object (TO) is not spherical in overall shape or volume, but nevertheless has a shape and is made of a material to be sufficiently streamlined so that it may be projected or launched into free space from a source apparatus such as the Launching Mechanism (LM) and then pass unassisted by connection or otherwise untethered to the Hitting Zone (HZ) along the Path (Pth) with at least a vertical Pitch-Like Arc—thus, unlike some prior devices, the Target Object (TO) travels from launch to the Hitting Zone (HZ) without an attached rope or affixation to some fixed point and not being extended at the end of a member. Moreover, the preferred Target Object (TO) if and once struck by the Batter (B) will travel only a limited distance so as to be relatively easily retrieved as compared to an actual baseball or softball, while providing some level of Multi-Dimensional Swing Feedback. By way of example, therefore, in one preferred embodiment, the Target Object (TO) is formed such as a dart, meaning it includes a portion with a majority of its length that, when the Target Object (TO) is projected along the projection Path (Pth) toward the Hitting Zone (HZ), the majority length travels linearly or otherwise in the Pitch-Like Arc along that projection Path (Pth).

Figure 2A:
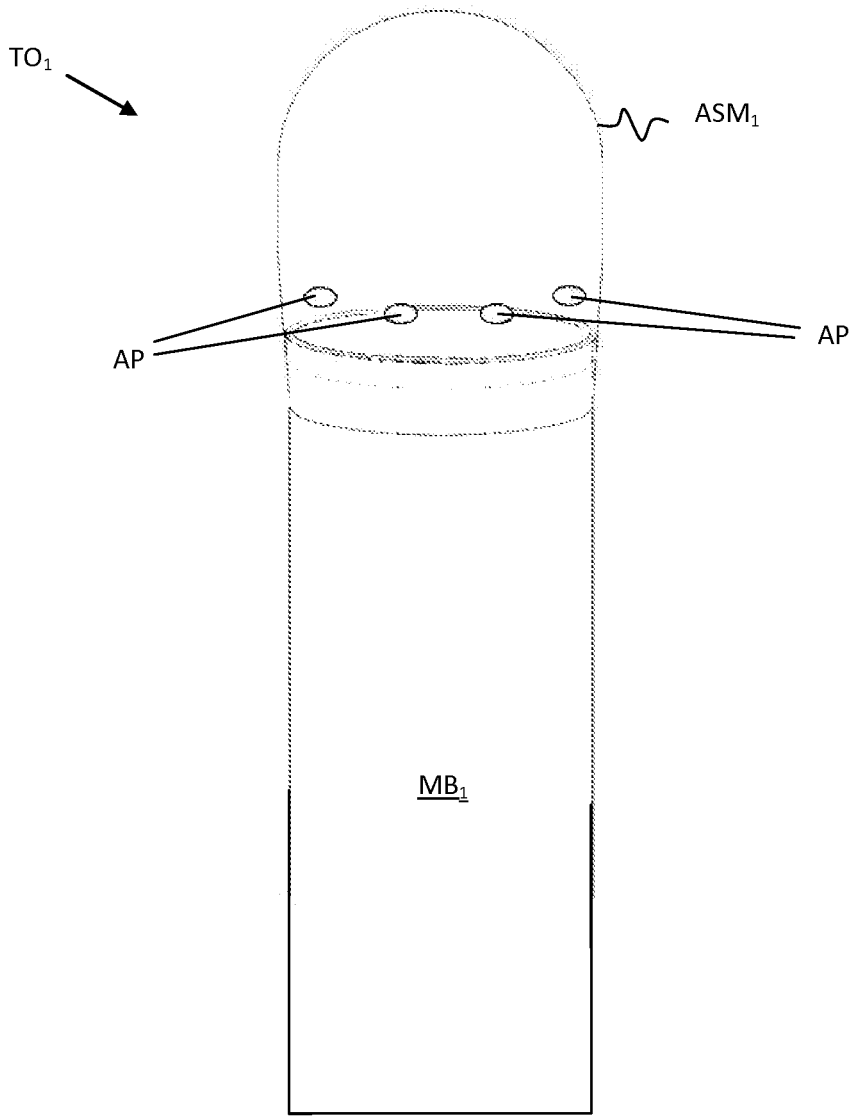
FIG. 2*a* illustrates a first preferred embodiment example of a target object.
Figure 2B:
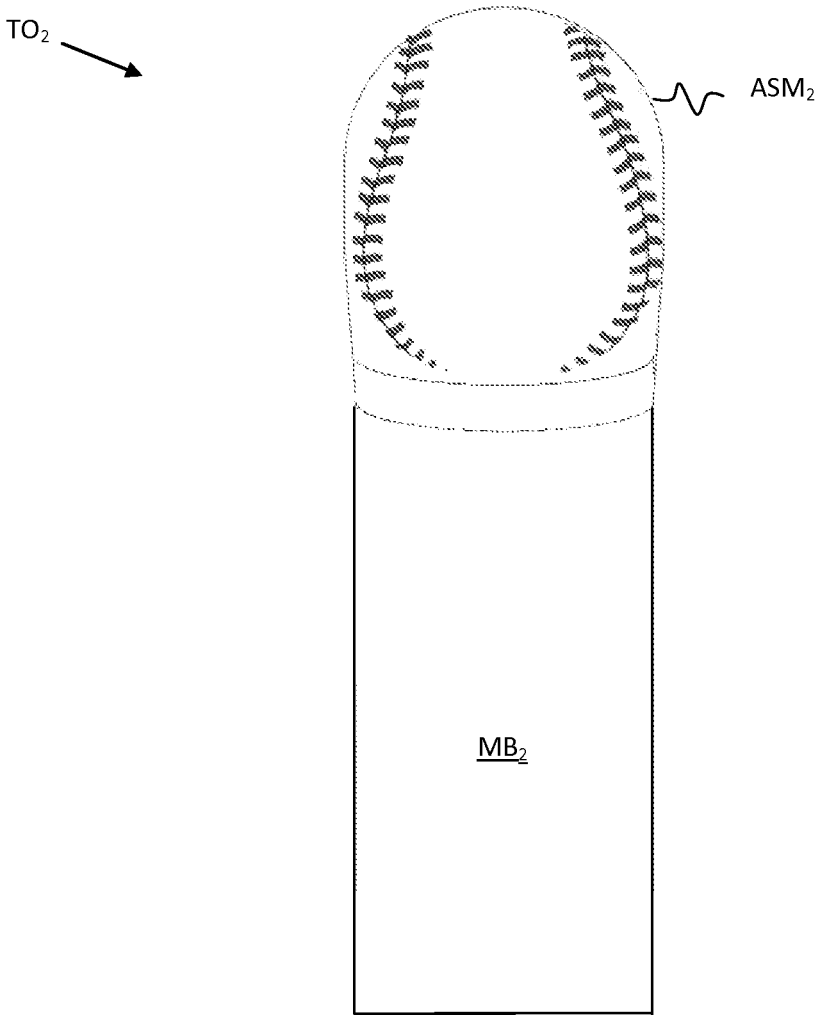
FIG. 2*b* illustrates a second preferred embodiment example of a target object.

FIGS. 2*a* and 2*b* illustrate alternative preferred embodiment examples of the Target Object, shown respectively as $TO_1$ and $TO_2$. Each Target Object $TO_x$ includes a main body member (MB) and an additional shaped member (ASM) attached to the main body member (MB). In either alternative, the preferred method of projecting the Target Object (TO) toward the Hitting Zone (HZ) is such the Target Object (TO) is launched so that it travels in the air with the additional shaped member (ASM) proceeding first. In this manner, therefore, the additional shaped member may be of various shapes and may assist the Target Object (TO) to pass in the Pitch-Like Arc toward the Hitting Zone (HZ). Indeed, in either alternative preferred embodiment of FIGS. 2*a* and 2*b*, the additional shaped member includes a portion that has an outer spherical shape. Moreover, the spherical shape may, as shown in FIG. 2*b*, simulate in shape and in indicia (e.g., simulate stitching) an actual baseball or softball, although preferably constructed of a material and/or size that does not add too much weight to the Target Object (TO) as further explored below. With the additional shape in the shape of a baseball or softball, or a miniature version thereof, as the Target Object (TO) approaches the Batter (B), the Batter (B) may concentrate on the additional shaped member (ASM) as the leading end of the Target Object (TO) advancing toward the Hitting Zone (HZ). Accordingly, the Batter (B) is provided in part with a comparable visual image to that of an actual baseball or softball, and the Batter (B) also endeavors to swing the bat and make contact with that additional shaped member (ASM) of the Target Object (TO). Lastly, note that Target Object $TO_1$ of FIG. 2*a* illustrates another aspect, namely, that its additional shaped member $ASM_1$ includes a mechanism for allowing the member to accept a certain amount while minimizing or eliminating any functional damage to the member; in the illustrated embodiment, this mechanism is by way of a plurality of apertures (AP) formed through the material that comprises the member. Thus, if the Batter (B) strikes the Target Object $TO_1$ with a bat, then some of the crushing force is dissipated by air passing through the apertures (AP). Also in this regard, the material for the additional shaped member (ASM) may be selected accordingly.

Figure 2C:
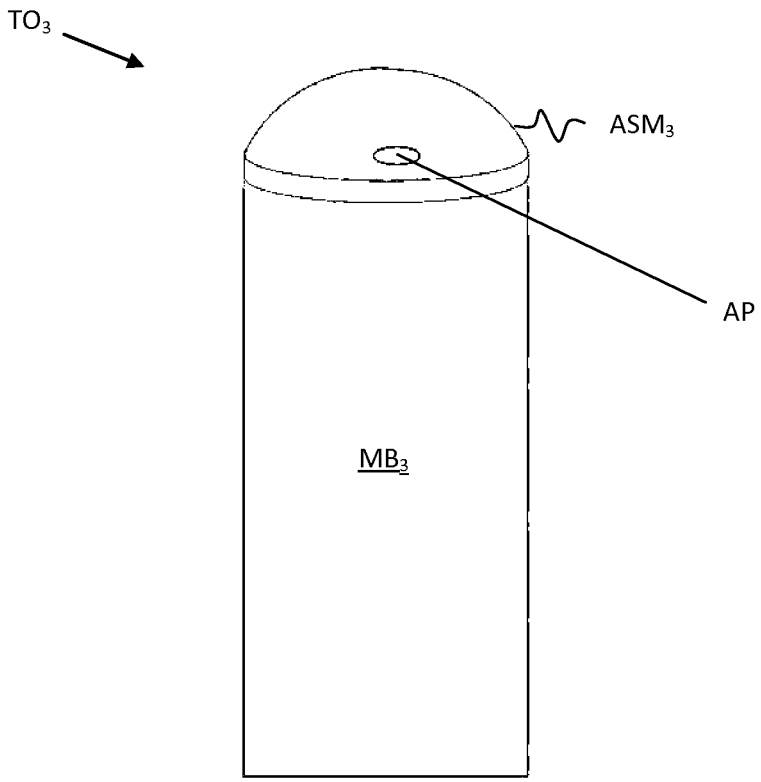
FIG. 2*c* illustrates a third preferred embodiment example of a target object.
Figure 2D:
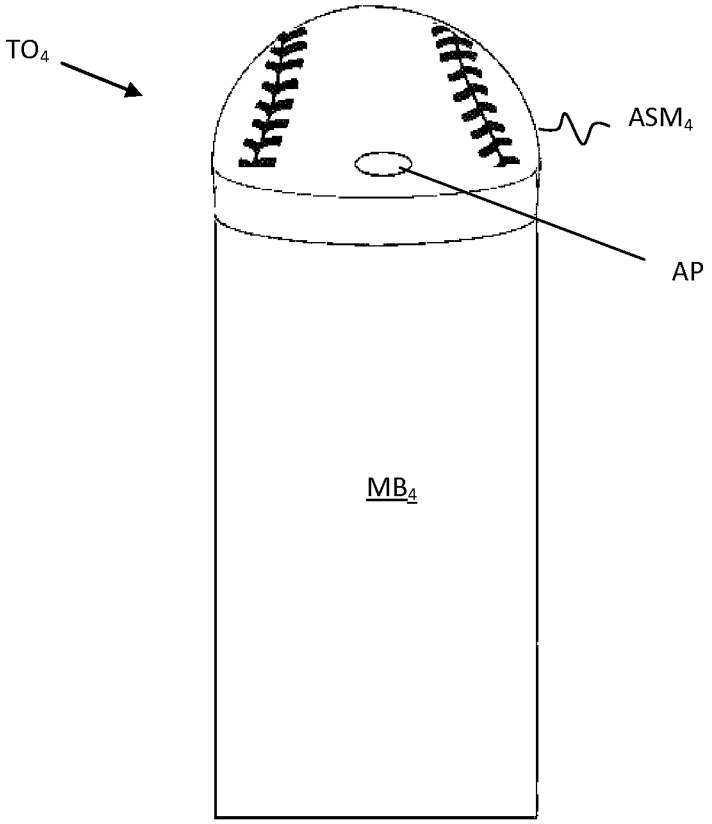
FIG. 2*d* illustrates a fourth preferred embodiment example of a target object.

FIGS. 2*c* and 2*d* illustrate additional alternative preferred embodiment examples of the Target Object, shown respectively as $TO_3$ and $TO_4$ and in certain respects comparable to target objects $TO_1$ and $TO_2$, respectively. As shown in FIGS. 2*c* and 2*d*, however, in these embodiments the additional shaped member (ASM) of each object is reduced in size as compared to its respective counterpart in FIGS. 2*a* and 2*b*. Such a structure may be advantageous for various reasons, including manufacture, coupling the additional shaped member (ASM) to its respective main body member (MB), and facilitating desired travel of the Target Object (TO) along its path to the Hitting Zone (HZ). Lastly, FIG. 2*d* also illustrates that the aperture(s) of FIG. 2*a* also may be included in an embodiment with the indicia of FIG. 2*d* (as also shown, without indicia, in FIG. 2*c*).

Various attributes of the Target Object (TO) are selected so as to assist it to travel through the air as just described. For example, the material of the Target Object (TO) is preferably such that if it is hit directly back at the person that launched the Object and strikes him, it will do no harm and generally due to its shape and other attributes will travel less than 25 feet when struck by a bat. In a preferred embodiment, therefore, the Target Object (TO) includes at least a portion constructed of a foam material. Thus, the length of the Target Object (TO) may be included as a portion of a foam dart. The Target Object (TO) as a foam dart therefore includes a length that is longer in the direction of the Pitch-Like Arc than in any other dimension, such as may be achieved by a tubular or cylindrical body, with either a hollow or solid interior or some other type of body or shaft that has a majority of its length extending along its flight path (i.e., in the direction of the Pitch-Like Arc). As another aspect, the preferred weight of the Target Object (TO), with or without an additional shaped member on one end, is less than an actual baseball, which weighs in the range of 5.0 to 5.25 ounces; indeed, a preferable Target Object (TO) weighs less than one or two ounces. In this manner, the Target Object (TO) requires less force to project from the Launching Mechanism (LM) (further described below) to the Hitting Zone (HZ), and the Target Object (TO) if successfully struck by the bat of a Batter (B) will travel a lesser distance than an actual baseball or softball. As still another aspect, the length of the Target Object (TO) shaft is preferably at least 2.5 inches. The additional shaped member (ASM) (e.g., as shown earlier or that also could be a rubber tip) is preferably 0.5 inches in length and weighs approximately 0.20 to 0.25 ounces, and preferably outweighs the remaining main body member (MB) of the Target Object (TO) (e.g., its cylindrical or other length body). Indeed, increasing the weight of the Target Object (TO) tip and the length of its shaft increases the speed of the Target Object (TO) in its flight toward the Hitting Zone (HZ), and therefore different values may be selected based on a desired speed. Moreover, in one preferred embodiment a kit is provided in which a plurality of different Target Objects are included, where certain of those Target Objects have different sizes/weights/flight attributes than others in the same kit; in this manner, a user may select a different Target Object (TO) among the variations to achieve a different speed or manner of travel of the Target Object (TO) as compared to the others when the Target Object (TO) is projected to the Hitting Zone (HZ); in other words, the user thereby may use different ones of the Target Objects to simulate or types of different speed "pitches" for batting practice. Also in this regard, therefore, other attributes of the plurality of Target Objects may be varied within the kit so the user can obtain other changes in flight path of the Target Object (TO), where for example different Target Objects simulate different types of pitches (e.g., curve, slider, cutter, sinker, splitter). One skilled in the art may readily ascertain various manners to cause the Target Object (TO) to fly in a path that slightly departs from the linear Path (Pth) shown in FIG. 1; for example, if a foam main body member ($MB_x$) is implemented such as shown in FIGS. 2*a* and 2*b*, certain weighting or slotting could be added thereto, as well as some aerodynamic feature (e.g., additional fin or tail) so as to cause the Target Object (TO) to fly in a predictable yet departing-from-linear path. Also in this regard, therefore, preferably an indicia is included on the Target Object (TO) so that it may be loaded into the Launching Mechanism (LM) (see FIG. 1) so that the direction that it departs from linear will be knowable to the operator and therefore predictable with respect to both the Hitting Zone (HZ) and the nearby Batter (B).

Alternative shaped members may be included as part of the Target Object (TO) in lieu of the shape described above. Some examples of such members may be ascertained by one skilled in the art given the teachings of this document. Moreover, either the additional shaped member (ASM) or the length of the Target Object (TO) may include a color or pattern so that the batter can be challenged to identify that color or pattern on any given swing. This provides additional training feedback as to how effectively the Batter (B) is tracking the Target Object (TO) into the Hitting Zone (HZ) based on how accurately he can identify the correct color following a given swing, thereby training the Batter (B) to watch the Target Object (TO) intently all the way into the Hitting Zone (HZ) and translating into a comparable amount of focus and concentration when the Batter (B) is faced with an actual baseball or softball. Thus, a batter's ability to consistently track the Target Object (TO) completely through the Hitting Zone (HZ) and on to the bat at contact will generally insure improved hitting results with an actual baseball or softball.

Various preferred embodiments also include the Launching Mechanism (LM) for accurately projecting the Target Object (TO) toward the Hitting Zone (HZ). Thus, as with an actual live pitch of a baseball or softball, a batter when using a preferred embodiment must track the flight of the Target Object (TO) as it travels from the Pitcher (P), at the source location of the Launching Mechanism (LM), toward and into the Hitting Zone (HZ). Moreover, during this time the Batter (B) must time his swing accurately and swing the bat effectively to hit and drive the Target Object (TO). In this regard, the preferred embodiment mechanism may be formed in various fashions so as to accommodate the attributes of the preferred Target Object (TO) in order to project it along a Pitch-Like Arc toward the Hitting Zone (HZ). In a preferred embodiment, therefore, the distance of trajectory from the Launching Mechanism (LM) to the Hitting Zone (HZ) is up to 20 to 30 feet and therefore the Launching Mechanism (LM) includes sufficient apparatus to project the Target Object (TO) that distance. Additionally in a preferred embodiment, the launching apparatus is constructed with a goal of launching each Target Object (TO) at a relatively consistent trajectory and speed. Toward these ends, in one preferred embodiment, the Launching Mechanism (LM) may be hand-held and manually operated, and in this regard may be readily achieved using a device selected from or akin to various commercially available foam dart guns.

In other preferred embodiments, the Launching Mechanism (LM) may include various modifications. As a first example, the Launching Mechanism (LM) may include a stand and/or additional apparatus so as to fix the mechanism relative to the ground (or other structure) as well as its launching direction to thereby increase the likelihood that each respective launch of a Target Object (TO) is along a similar or virtually the same path as the previous launch. As a second example, the Launching Mechanism (LM) may include adjustable apparatus so that adjustments may be made after one or more launched Target Objects in order to aim the next or successive Target Objects to particular spots in the Hitting Zone (HZ). As yet another example, the Launching Mechanism (LM) and/or the Target Object (TO) may include features to vary the speed or manner of flight of a given Target Object (TO) to differ from that of another Target Object (TO). As still another example, the Launching Mechanism (LM) may include a chamber for housing multiple Target Objects (TO) and/or a chamber that may be loaded with multiple Target Objects so that each such Target Object (TO) in the chamber may be individually launched by the Launching Mechanism (LM) before there is a need to re-load the Launching Mechanism (LM). As a final example, the Launching Mechanism (LM) may include a remote control or automated launch feature, whereby the Batter (B) may set up the Launching Mechanism (LM) and then conduct batting practice by himself without requiring an additional person to manually operate the Launching Mechanism (LM) for each launched Target Object (TO). In all events, in a preferred embodiment the Target Object (TO) and/or Launching Mechanism (LM) are such that the Target Object (TO) travels somewhere around 20 to 30 mph (e.g., 25 mph) in the range of 25 to 30 feet from the location of the Batter (B). These attributes produce a realistic "pitch" pace, generating an effective reaction time for the Batter (B), particularly at the typical age range of a developing or learning batter. Thus, the Batter (B) must see the "pitch" (i.e., oncoming Target Object (TO)), determine if the path of the Object will provide a ball or strike, and commit to the swing in a usefully realistic timeline. The Pitcher (P) can slow the pace by increasing the distance to the Batter (B) and adjusting the arc of the projection, or conversely move closer to the Batter (B) to increase challenge to more developed hitters or by adjusting one or more of the adjustable features described above. In all events, therefore, the Launching Mechanism (LM) includes a desirable projectile function that is consistent with the materials and form factor of the Target Object (TO), which may include therefore a mechanical and/or electrical apparatus, including but not limited to a spring loading or air compressing launching apparatus. Moreover, the form factor of the Launching Mechanism (LM) itself may be altered as within the present inventive scope.

Given the above, a preferred embodiment includes a training system kit for teaching an athlete to swing a bat or other member at a free traveling Target Object (TO). The kit preferably includes one or more Target Objects along with a Launching Mechanism (LM) for the Target Objects to be projected to a Hitting Zone (HZ) proximate the athlete. The kit may further include the bat or the athlete may obtain that elsewhere. Further, the kit may include instructions and or accompanying electronic media to illustrate the use of other components in the kit as well as to illustrate tips and techniques for an educator (e.g., coach) that is using the kit components to teach batting or the like. Thus, such a coach may work with a batter whereby the coach operates the Launching Mechanism (LM), consistent with the above principles, to provide a batting practice that in many respects simulates an actual real batting practice that is traditionally achieved as described earlier, yet with the numerous benefits of the preferred embodiment as detailed in this document.

From the preceding, one skilled in the art will appreciate that the preferred embodiments provide numerous benefits and certain advantages over prior systems, methods, and apparatus for training a batter or the like. For example, relatively minimal space is required to use the system and methodology, just a distance of 30' or less and enough space to swing a bat. As another example, the Target Object (TO) when struck provides immediate meaningful feedback as to relative success of individual swings (or lack thereof) based on real time flight response of each struck Target Object (TO), while at the same time there is relative ease, greatly reduced energy, and reduced time expended in recovering each Target Object (TO) and a considerably reduced danger from the flight of each Target Object as compared to a traditional ball. As another example, the preferred embodiments deliver the Target Object (TO) into the Hitting Zone (HZ) accurately with relative ease as compared with consistently delivering an actual pitched ball into a strike zone. As another example, a favorably shaped and weighted Target Object (TO) of an appropriate material requires realistic timing (the requisite learned rhythm for hitting a moving object with a bat), focus on hand/eye coordination, and a pitch-like arc that effectively simulates the arc of an actual pitched ball. Moreover, the preferred embodiments provide safety for a batter as compared to manually pitching and/or receiving hard balls that carry an increase risk of striking and potentially injuring a batter). With the increase in safety, there is also less risk in varying the projectile path in the Hitting Zone (HZ) and therefore increasing the variability with each "pitch," thereby challenging the batter to track variable incoming "pitches" of the Target Object and allowing the batter to comfortably increase a sense of discernment between "pitches" that are in the Hitting Zone (HZ) (desirable 'strikes" at which to swing) and those that are not in the Hitting Zone (HZ) (undesirable "balls" which should not be swung at). As yet another example, the preferred embodiments allow a batter to use an actual game bat while posing no risk of damage or wear to the bat during practice (e.g. discoloration, deadening of barrel, etc), which is increasingly more important given the greater complexity and cost of contemporary bats. Still further, the preferred embodiments enable a larger number of repetitions in a highly concentrated timeframe as compared to various prior art approaches and can be used either indoors or outdoors. Moreover, one skilled in the art may readily construct various apparatus consistent with the teaching herein according to readily ascertainable technologies. Lastly, while the present embodiments have been described in detail, various substitutions, modifications or alterations could be made to the descriptions set forth above without departing from the present inventive scope.

The invention claimed is:

1. A method for training a user to swing a member at a moving target, comprising:

receiving in a first area proximate the member a target object projected by a launching mechanism located at a second area that is distant from the first area, the target object traveling along a free space path from the second area to the first area, to pass along the free space path unassisted by connection, and untethered, to the launching mechanism, the target object traveling in a path that forms a pitch-like arc and simulates a baseball/softball pitch from, the launching mechanism at the second area, to a batter represented as a user, at the first area;

striking, by the user, the target object with the member; and wherein the target object comprises a cylindrical target member having a length, and the length of the target member forms at least a majority of a total length of the target object and the length of the target member aligns along the free space path as the target object passes toward the area; and wherein the target object further comprises an additional shaped member and the additional shaped member comprises a plurality of apertures for dissipating force imposed on the target object by the striking step.

2. The method of claim 1 wherein the target object is non-spherical.

3. The method of claim 1 wherein the target member comprises foam.

4. The method of claim 1 wherein the target member comprises a length no greater than 2.5 inches.

5. The method of claim 1 wherein the target object weighs less than two ounces.

6. The method of claim 1 wherein the target object comprises a cylindrical shaft that is preferably at least 2.5 inches.

7. The method of claim 1 wherein the target object further comprises an additional shaped member at a leading edge of the target object, wherein the receiving step comprises receiving firstly the leading edge of the target object in the area.

8. The method of claim 7 wherein the cylindrical target member has a width and wherein the additional shaped member comprises a width no greater than the width of the cylindrical portion.

9. The method of claim 7 wherein the additional shaped member comprises an indicia representing seams of a baseball or softball.

10. The method of claim 1 wherein the materials, weight, and shape comprising the target object limit the striking step to cause the target object to travel no more than 25 feet from the hitting area.

11. The method of claim 1 wherein the materials, weight, and shape comprising the target object limit the striking step to cause the target object to travel no more than 50 feet from the hitting area.

12. The method of claim 1 wherein the launching mechanism comprises a mechanism for adjusting a speed of travel of the target object.

13. The method of claim 1 wherein the launching mechanism comprises a mechanism for adjusting a directional path of launch of the target object.

14. The method of claim 1 wherein the launching mechanism comprises a mechanism for storing a plurality of target objects.

15. The method of claim 1 wherein the launching mechanism comprises an automated mechanism for launching the target object without the launching mechanism being operated by a user at the time the target object is launched.

16. The method of claim 1 wherein the receiving step comprises receiving the target object projected along a linear free space path toward the area.

17. The method of claim 1 wherein the receiving step comprises receiving the target object projected along a linear free space path that comprises a non-linear portion along the path.

18. The method of claim 1 wherein the wherein the target object comprises means for causing the target object to move along the free space path in a manner that comprises a non-linear portion along the path.

19. The method of claim 1 wherein the target object comprises means for causing the target object to travel along the free space path in a non-linear direction.

* * * * *